US010222090B2

(12) United States Patent
Kamijo et al.

(10) Patent No.: US 10,222,090 B2
(45) Date of Patent: Mar. 5, 2019

(54) INDOOR UNIT FOR AIR-CONDITIONING APPARATUS, AND AIR-CONDITIONING APPARATUS

(71) Applicant: Mitsubishi Electric Corporation, Tokyo (JP)

(72) Inventors: Masahiro Kamijo, Tokyo (JP); Masahiko Takagi, Tokyo (JP); Tatsuo Furuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/740,553

(22) PCT Filed: Sep. 1, 2015

(86) PCT No.: PCT/JP2015/074817
§ 371 (c)(1),
(2) Date: Dec. 28, 2017

(87) PCT Pub. No.: WO2017/037862
PCT Pub. Date: Mar. 9, 2017

(65) Prior Publication Data
US 2018/0195757 A1 Jul. 12, 2018

(51) Int. Cl.
*F24F 1/00* (2011.01)
*F24F 13/20* (2006.01)
(Continued)

(52) U.S. Cl.
CPC ..... *F24F 13/20* (2013.01); *F24F 13/32* (2013.01); *F25D 23/067* (2013.01); *F24F 2001/0037* (2013.01); *F24F 2013/0616* (2013.01)

(58) Field of Classification Search
CPC .... F24F 13/20; F24F 13/32; F24F 2001/0037; F24F 2013/0616; F25D 23/067
(Continued)

(56) References Cited

U.S. PATENT DOCUMENTS

2016/0102906 A1 4/2016 Furuta et al.

FOREIGN PATENT DOCUMENTS

JP 2006-017342 A 1/2006
JP 2014-215024 A 11/2014
(Continued)

OTHER PUBLICATIONS

International Search Report dated Nov. 24, 2015 issued in corresponding International application No. PCT/JP2015/074817 (and English translation attached).
(Continued)

*Primary Examiner* — Ana M Vazquez
(74) *Attorney, Agent, or Firm* — Posz Law Group, PLC

(57) ABSTRACT

An indoor unit for an air-conditioning apparatus and an air-conditioning apparatus that include levers of a decorative panel operated through insertion hole portions, and then move vertically in the insertion hole portions by the gravity, to thereby be temporarily hung on the hooks. The levers are kept holed on hooks. The indoor unit for an air-conditioning apparatus includes a casing, a decorative panel mounted on a lower surface side of the casing and having an air inlet formed therein, the levers mounted so as to be opposed to each other on opposed two sides among four sides forming edges of the air inlet of the decorative panel, and the hooks mounted at an opening portion of the casing, to allow the levers to be hooked thereon, respectively.

9 Claims, 8 Drawing Sheets

(51) Int. Cl.

| | |
|---|---|
| ***F24F 13/32*** | (2006.01) |
| ***F25D 23/06*** | (2006.01) |
| *F24F 13/06* | (2006.01) |

(58) Field of Classification Search
USPC ..... 62/302
See application file for complete search history.

(56) References Cited

FOREIGN PATENT DOCUMENTS

| | | | | |
|---|---|---|---|---|
| JP | 2014215024 | A | * | 11/2014 |
| JP | 2015-021662 | A | | 2/2015 |

OTHER PUBLICATIONS

Extended EP Search Report dated May 22, 2017 issued in corresponding EP patent application No. 15890156.
Office Action dated Jun. 19, 2018 issued in corresponding Japanese patent application No. 2017-537117 (and English translation).

* cited by examiner

A-A SECTION

B-B SECTION

INDOOR UNIT FOR AIR-CONDITIONING APPARATUS, AND AIR-CONDITIONING APPARATUS

CROSS REFERENCE TO RELATED APPLICATION

This application is a U.S. national stage application of PCT/JP2015/074817 filed on Sep. 1, 2015, the contents of which are incorporated herein by reference.

TECHNICAL FIELD

The present invention relates to an indoor unit for an air-conditioning apparatus, and to an air-conditioning apparatus, and more particularly, to the structure for temporarily hanging a decorative panel on the indoor unit for an air-conditioning apparatus.

BACKGROUND ART

In a related-art air-conditioning apparatus, for example, a four-way cassette-type indoor unit has the structure, in which an indoor unit body is suspended in a space above a ceiling, and in which a decorative panel is mounted to cover a surface of the indoor unit body facing an inside of a room. For example, in Patent Literature 1 and Patent Literature 2, there is proposed that, when the decorative panel is mounted to the indoor unit body, temporary hanging levers arranged at two positions of edge portions of an air inlet of the decorative panel are hooked on L-shaped temporary hanging hooks formed on the indoor unit body. The decorative panel in a temporarily hung state is then fixed to the indoor unit body with screws. When the decorative panel fixed to the indoor unit body is dismounted, the decorative panel is released from screw fixation, thereby being brought into the temporarily hung state. After that, the decorative panel is dismounted from the indoor unit body by unhooking the temporary hanging levers while lifting up the decorative panel.

CITATION LIST

Patent Literature

Patent Literature 1: Japanese Unexamined Patent Application Publication No. 2015-021662

Patent Literature 2: Japanese Unexamined Patent Application Publication No. 2014-215024

SUMMARY OF INVENTION

Technical Problem

When the decorative panel is mounted to the indoor unit body positioned above the ceiling, under a state in which the decorative panel is temporarily hung, an inclination and a position of the decorative panel sometimes needs to be finely adjusted so as to be conformed to a hole and an orientation of the ceiling. When the position and other conditions of the decorative panel are finely adjusted under a state in which the decorative panel is temporarily hung by the temporary hanging levers proposed in Patent Literature 1 and Patent Literature 2, the temporary hanging levers are also moved along with movement of the decorative panel so that a positional relationship between the temporary hanging levers and the temporary hanging hooks is changed. As a result, the temporary hanging hooks are liable to unintentionally slip out of the temporary hanging levers. Accordingly, when, for example, fine adjustment is performed, it is necessary to carefully perform work so as not to cause the temporary hanging to be cancelled. Further, when fixing screws are unfastened in order to dismount the decorative panel that is fixed and remains under the state in which the temporary hanging is cancelled, the decorative panel is dismounted under a state in which the decorative panel is not temporarily hung. Consequently, safety of a worker is impaired.

It is an object of the present invention to provide an indoor unit for an air-conditioning apparatus, and an air-conditioning apparatus capable of keeping a decorative panel temporarily hung even when a position of the panel is finely adjusted during mounting of the decorative panel and when the decorative panel is dismounted.

Solution to Problem

According to one embodiment of the present invention, there is provided an indoor unit for an air-conditioning apparatus, including a casing having an opening portion formed on a side being a lower surface side when the indoor unit is installed, a decorative panel mounted on the lower surface side of the casing, and having an air inlet formed into a rectangular shape at a position corresponding to the opening portion, levers so as to be opposed to each other on opposed two sides among four sides forming edges of the air inlet of the decorative panel, and hooks mounted at the opening portion of the casing to allow the levers to be hooked thereon, respectively. The decorative panel includes an insertion hole portion formed in a direction perpendicular to a plane of the decorative panel at a position at which each of the levers is to be mounted, and bearing groove portions formed in a lower surface portion of the decorative panel so as to extend in parallel with the plane of the decorative panel and extend in directions away from each other with respect to the insertion hole portion. The each of the levers is movable in the insertion hole portion, and includes a hook portion to be hooked on each of the hooks, and shaft portions formed at both ends of the each of the levers, respectively. The hook portion protruding upward from the insertion hole portion of the decorative panel, the shaft portions are received in the bearing groove portions of the decorative panel, respectively.

Advantageous Effects of Invention

According to the indoor unit for an air-conditioning apparatus of one embodiment of the present invention, the pair of levers is mounted to the opposed two sides of edge portions of the air inlet of the decorative panel. Further, each lever is turned through the insertion hole portion of the decorative panel through which the lever is inserted so that the lever is oriented perpendicular to the decorative panel. Subsequently, the lever is moved by the gravity to fall in the insertion hole portion of the decorative panel, and then is hooked on each hook of the casing, and kept hooked. Accordingly, the decorative panel can be easily and temporarily hung while being supported by hand. When the hung decorative panel is moved up and down, the lever is moved in the insertion hole portion, but a positional relationship between the lever and the hook is not changed. Thus, the decorative panel can be kept temporarily hung, for example, even when a position of the decorative panel is finely adjusted and when the decorative panel is dismounted.

Therefore, a temporary hanging lever can be prevented from unintentionally slipping out of the hanging hook which is used for temporary hanging.

DESCRIPTION OF EMBODIMENTS

Embodiment 1

Figure 1:
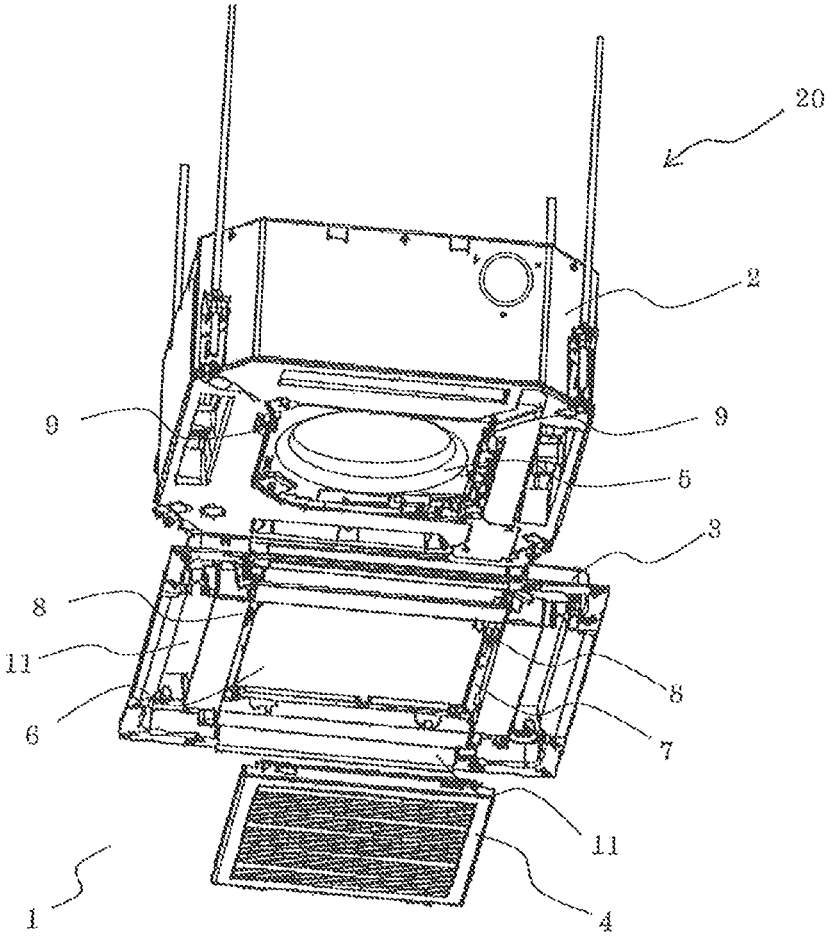
FIG. 1 is an exploded perspective view for illustrating an indoor unit for an air-conditioning apparatus according to Embodiment 1 of the present invention.

FIG. 1 is an exploded perspective view for illustrating an indoor unit 20 for an air-conditioning apparatus according to Embodiment 1 of the present invention. In the following description, the indoor unit for an air-conditioning apparatus is simply referred to as the indoor unit 20. The indoor unit 20 according to this embodiment is connected to an outdoor unit by refrigerant pipes, and constructs, together with the outdoor unit, an air-conditioning apparatus configured to perform refrigeration, air-conditioning, or other operations by circulating refrigerant through a refrigerant circuit. The indoor unit 20 according to this embodiment is a ceiling-concealed indoor unit. In the following, as an example of the ceiling-concealed indoor unit, a four-way cassette-type indoor unit is described.

As illustrated in FIG. 1, the indoor unit 20 according to this embodiment is concealed and installed above a ceiling of an indoor space 1. In the following description, a direction of the ceiling is referred to as an upward direction, and a direction of viewing the indoor space 1 from the ceiling is referred to as a downward direction. The indoor unit 20 includes an indoor fan, a casing 2 configured to accommodate an indoor heat exchanger and other components, a decorative panel 3, and an air inlet grille 4. The casing 2 includes a bellmouth 5 configured to straighten air when the indoor fan is driven. The bellmouth 5 is arranged in an opening formed in the casing 2. A pair of temporary hanging hooks 9, on which the decorative panel 3 is to be temporarily hung, is arranged on an outer portion of the casing 2 with respect to the bellmouth 5.

The decorative panel 3 is mounted on a lower surface of the casing 2 being an indoor side so as to cover the casing 2. A rectangular opening is formed in a center portion of the decorative panel 3 at a position corresponding to the opening of the casing 2, and forms an air inlet space 6 through which the air is sucked from the indoor space when the indoor fan is driven. The air inlet space 6 is covered with the air inlet grille 4. Four edges defining the air inlet space 6 form air inlet edge portions 7. An air outlet 11 is formed on an outer side of each of the air inlet edge portions 7. The air having passed through the indoor heat exchanger is blown into the indoor space through the air outlet 11.

Temporary hanging levers 8 are respectively mounted to any one pair of opposed sides among two pairs of opposed sides of the four air inlet edge portions 7. The temporary hanging levers 8 pass through the decorative panel 3, and protrude from an upper surface of the decorative panel 3. The temporary hanging levers 8 are arranged at opposed positions that are line-symmetric with respect to a line being parallel to the opposed two sides passing through a center of the air inlet space 6. The temporary hanging levers 8 are temporarily hung on the temporary hanging hooks 9 of the casing 2 arranged at positions opposed to the temporary hanging levers 8. The temporary hanging levers 8 and the temporary hanging hooks 9 correspond to levers and hooks according to the present invention.

Figure 2:
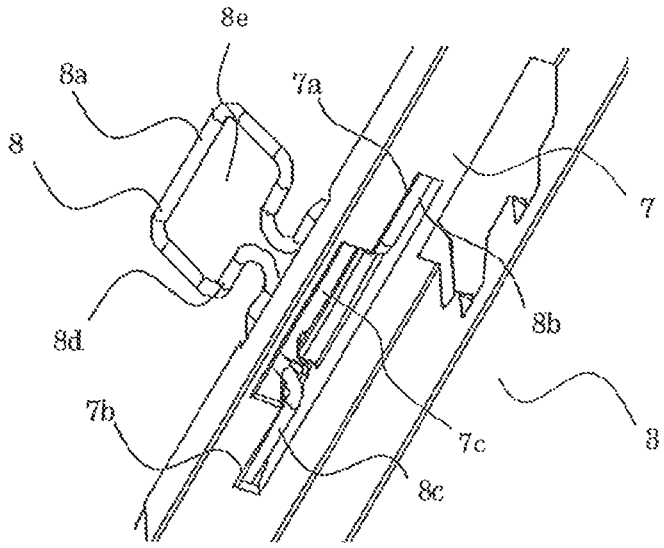
FIG. 2 is an enlarged view for illustrating a state before temporary hanging levers of FIG. 1 are temporarily hung.

FIG. 2 is an enlarged view for illustrating a state before the temporary hanging levers 8 of FIG. 1 are temporarily hung. As illustrated in FIG. 2, under the state before the temporary hanging levers 8 are temporarily hung, the temporary hanging levers 8 mounted to the air inlet edge portions 7 of the decorative panel 3 are inclined so as to protrude into the air inlet space 6. Specifically, an upper end portion of each of the temporary hanging levers 8 is inclined toward the air inlet space 6 side with respect to a direction perpendicular to a plane of the decorative panel 3.

An insertion hole portion 7*c* through which each temporary hanging lever 8 is inserted, and bearing groove portions 7*a* and 7*b* continuous with the insertion hole portion 7*c* are formed in each air inlet edge portion 7. The insertion hole portion 7*c* is a rectangular hole formed in the direction perpendicular to the plane of the decorative panel 3. The temporary hanging lever 8 can be moved upward and downward in the insertion hole portion 7*c*. The bearing groove portions 7*a* and 7*b* are grooves extending from the insertion hole portion 7*c* as a center and in directions in parallel with the plane of the decorative panel 3 and along the air inlet edge portion 7. The bearing groove portions 7*a* and 7*b* are formed in the lower surface of the decorative panel 3.

Each temporary hanging lever 8 includes a hook portion 8*a* to be hooked on the temporary hanging hook 9, shaft portions 8*b* and 8*c* respectively formed at both end portions of the temporary hanging lever 8, and an operating portion 8*d* connecting the hook portion 8*a* and the shaft portions 8*b* and 8*c* together. The temporary hanging lever 8 is formed by processing, for example, an iron wire. The temporary hanging lever 8 is mounted to the air inlet edge portion 7 of the decorative panel 3 by inserting an elastically deformed member through the insertion hole portion 7*c* of the decorative panel 3 and inserting the shaft portions 8*b* and 8*c* in the bearing groove portions 7*a* and 7*b*, respectively. The temporary hanging lever 8 is formed, for example, by bending a single iron wire. A center portion of the single iron wire, both end portions of the single iron wire, and a portion connecting the center portion and the both end portions function as the hook portion 8*a*, the shaft portions 8*b* and 8*c*, and the operating portion 8*d*, respectively.

The hook portion 8*a* has a U-shape, and has a space 8*e* through which the temporary hanging lever 8 is hooked on the temporary hanging hook 9 of the casing 2. The shaft portions 8*b* and 8*c* are formed at both end portions of the temporary hanging lever 8, respectively. The shaft portions 8*b* and 8*c* are received in the bearing groove portions 7*a* and 7*b* in a turnable manner, and equivalent of rotational axis when the temporary hanging lever 8 is turned. The operating portion 8*d* is formed of two iron wires connecting the hook portion 8*a* and the shaft portions 8*b* and 8*c*, and includes a widthwise narrow portion at a position corresponding to the insertion hole portion 7*c*. The operating portion 8*d* is formed to enable a worker to perform operation of turning or sliding the temporary hanging lever 8 with placing a finger on the operating portion 8*d* from the lower surface through the insertion hole portion 7*c* while supporting the decorative panel 3 by hand.

An example of a specific shape of the temporary hanging lever 8 is described. The single iron wire forming the temporary hanging lever 8 is bent, at a center portion thereof serving as the hook portion 8*a*, into a U-shape while defining the space 8*e*. The iron wire is bent at positions of both ends of the hook portion 8*a* so as to bring the both ends close to each other toward a center of the iron wire, thereby forming the operating portion 8*d* including the narrow portion. The operating portion 8*d* is continuous with the hook portion 8*a*. In addition, the iron wire is bent at the right angle from terminal end portions of the narrow portion of the operating portion 8*d* so that the bent portions extend in opposite directions, thereby forming the shaft portions 8*b* and 8*c*, The hook portion 8*a* and the operating portion 8*d* are inserted into the insertion hole portion 7*c*, and the shaft portions 8*b* and 8*c* are received in the bearing groove portions 7*a* and 7*b*, respectively. Thus, the temporary hanging lever 8 is mounted to the air inlet edge portion 7.

Figure 3:
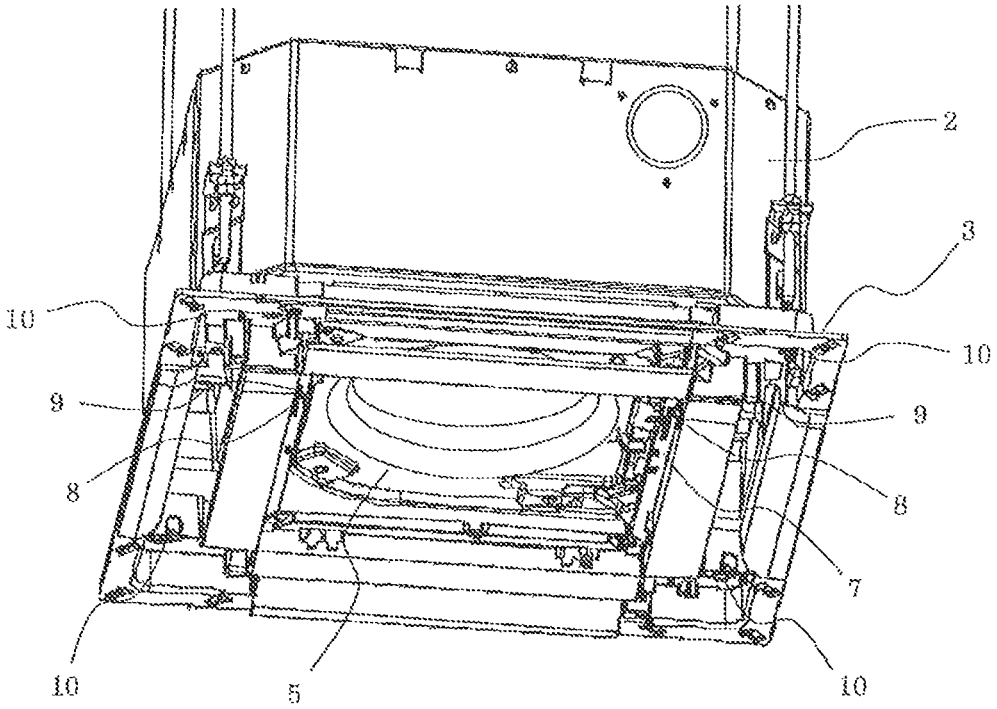
FIG. 3 is a view for illustrating a state in which a decorative panel is temporarily hung on a casing of FIG. 1.

Next, a step of temporarily hanging in which the temporary hanging lever 8 is engaged with the temporary hanging hook 9 and installing the decorative panel 3 on the casing 2 is described. FIG. 3 is a view for illustrating a state in which the decorative panel 3 is temporarily hung on the casing 2 of FIG. 1. As illustrated in FIG. 3, installation screw portions 10 configured to fix the decorative panel 3 with screws are formed at four corners of the decorative panel 3. When the decorative panel 3 is fixed and installed on the casing 2, first, the decorative panel 3 is positioned below the casing 2, and the decorative panel 3 is lifted up and brought close to the casing 2.

Figure 4:
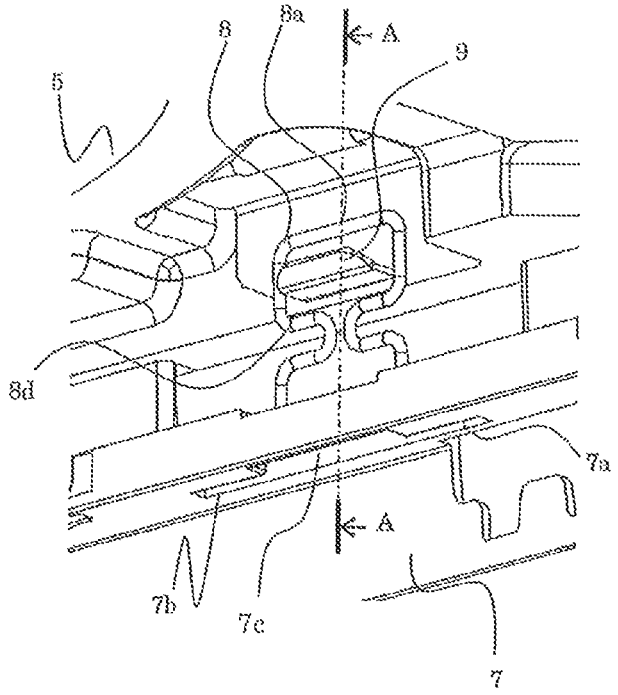
FIG. 4 is an enlarged view for illustrating a state immediately before the temporary hanging levers of FIG. 3 are temporarily hung.
Figure 5:
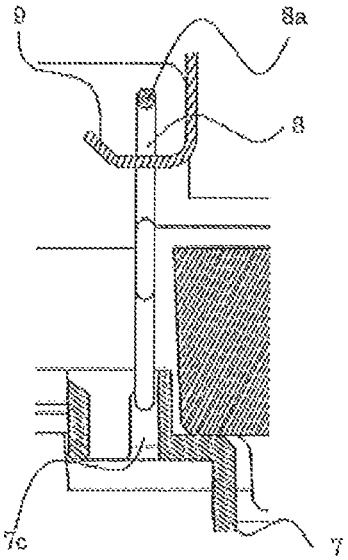
FIG. 5 is a sectional view taken along the line A-A of FIG. 4.

FIG. 4 is an enlarged view for illustrating a state immediately before the temporary hanging levers 8 of FIG. 3 are temporarily hung. Further, FIG. 5 is a sectional view taken along the line A-A of FIG. 4. As illustrated in FIG. 4 and FIG. 5, in the lifted decorative panel 3, the operating portion 8*d* is operated, and the hook portion 8*a* inclined so as to protrude into the air inlet space 6 side is turned to the air inlet edge portion 7 side. A worker operates the operating portion 8*d* through the insertion hole portion 7*c* while holding the air inlet edge portion 7 of the decorative panel 3. When a worker performs operation of, for example, placing a finger on the operating portion 8*d*, the temporary hanging lever 8 is turned and brought into a state of being perpendicular to the decorative panel 3 immediately before the temporary hanging lever 8 is temporarily hung.

Figure 6:
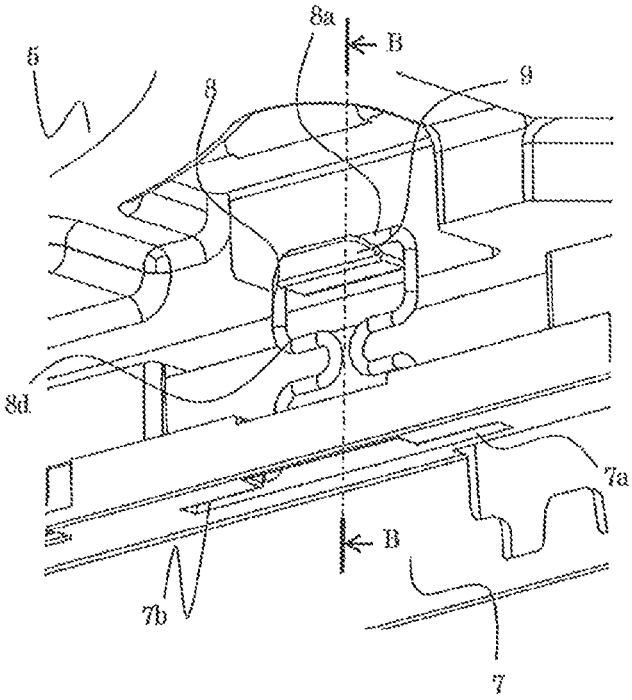
FIG. 6 is an enlarged view for illustrating a state in which the temporary hanging levers of FIG. 3 are temporarily hung.
Figure 7:
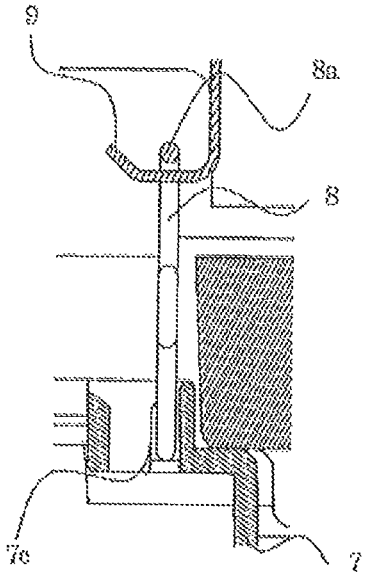
FIG. 7 is a sectional view taken along the line B-B of FIG. 6.

FIG. 6 is an enlarged view for illustrating a state in which the temporary hanging levers 8 are temporarily hung. Further, FIG. 7 is a sectional view taken along the B-B of FIG. 6. As illustrated in FIG. 6 and FIG. 7, the temporary hanging lever 8 perpendicular to the decorative panel 3 moves downward by the gravity in the insertion hole portion 7*c* formed in the air inlet edge portion 7 from the state immediately before each temporary hanging lever 8 is temporarily hung, and then falls into the insertion hole portion 7*c*. When the temporary hanging lever 8 moves downward, the hook portion 8*a* of the temporary hanging lever 8 is hooked on the temporary hanging hook 9 so that the temporary hanging lever 8 is temporarily hung on the temporary hanging hook 9. A distal end of the temporary hanging hook 9 has a hook shape. The hook shape prevents the temporary hanging lever 8 from being erroneously turned to the air inlet space 6 side and slipping off.

The decorative panel 3 in the temporarily hung state moves downward so that the shaft portions 8*b* and 8*c* of the temporary hanging lever 8 and the bearing groove portions 7*a* and 7*b* of the decorative panel 3 receiving the shaft portions 8*b* and 8*c* are engaged with each other. In this state, the decorative panel 3 is restrained from moving downward from a position at which the shaft portions 8*b* and 8*c* are engaged with the bearing groove portions 7*a* and 7*b*. As a result, an operator does not need to support the decorative panel 3. When the decorative panel 3 is moved upward from the engaged position, the temporary hanging lever 8 is moved in the insertion hole portion 7*c*, and the bearing groove portions 7*a* and 7*b* and the shaft portions 8*b* and 8*c* are disengaged from each other, with the result that the shaft portions 8*b* and 8*c* are moved downward in the bearing groove portions 7*a* and 7*b*. Thus, even when the bearing groove portions 7*a* and 7*b* are moved upward, the shaft portions 8*b* and 8*c* are not moved in conjunction with movement of the decorative panel thereby keeping a positional relationship between the temporary hanging lever 8 and the temporary hanging hook 9. For example, even in a case where the decorative panel 3 is moved upward and downward when a height or an arrangement position of the decorative panel 3 is adjusted, the temporarily hung state is kept so that the temporary hanging lever 8 is not disengaged from the temporary hanging hook 9.

After the decorative panel 3 is temporarily hung and adjusted, the casing 2 and the decorative panel 3 are fastened together with screws through the installation screw portions 10 of the decorative panel 3, to thereby fix the decorative panel 3 to the casing 2. When the installation screw portions 10 are fastened, the decorative panel 3 is brought close to the casing 2, and a position of the decorative panel 3 is moved upward. Also at this time, the temporary hanging lever 8 in the temporarily hung state is moved in the insertion hole portion 7*c* of the decorative panel 3, but is not in conjunction with movement of the decorative panel 3. Accordingly, the temporary hanging lever 8 is kept hooked on the temporary hanging hook 9.

When the decorative panel 3 is dismounted from the casing 2, the installation screw portions 10 are unfastened so that the decorative panel 3 is temporarily hung on the casing 2. In this state, the decorative panel 3 is lifted up, and the operating portion 8*d* is operated to turn the temporary hanging lever 8. Thus, the hook portion 8*a* is brought into the state illustrated in FIG. 2 in which the hook portion 8*a* is inclined so as to protrude into the air inlet space 6 side. Then, when the decorative panel 3 is lifted down, the decorative panel 3 can be dismounted from the casing 2. Thus, even when the installation screw portions 10 are unfastened, the decorative panel 3 is kept temporarily hung. Further, the temporarily hung state of the decorative panel 3 is cancelled by inclining the hook portion 8*a* toward the air inlet space 6 side. Accordingly, the decorative panel 3 can be dismounted from the casing 2 without being dropped.

As described above, the temporary hanging levers 8 are mounted to the opposed two sides of the air inlet edge portions 7 of the decorative panel 3. Accordingly, a worker and other persons can hold edge portions of the air inlet while operating the temporary hanging levers 8. Further, when the shaft portions 8*b* and 8*c* are turned through the insertion hole portion 7*c* of each air inlet edge portion 7 and then each inclined temporary hanging lever 8 is turned to the orientation perpendicular to the decorative panel 3, the entire temporary hanging lever 8 moves downward to fall into the insertion hole portion 7*c* of the air inlet edge portion 7, thereby being hooked on the temporary hanging hook 9. Thus, a worker can operate the temporary hanging lever 8 through the insertion hole portion 7*c* while supporting the decorative panel by hand, and can hook the temporary hanging lever 8 on the temporary hanging hook 9 by the gravity.

Under a state in which the shaft portions 8*b* and 8*c* are engaged with the bearing groove portions 7*a* and 7*b*, respectively, the decorative panel 3 is restrained from moving downward. When the decorative panel 3 is moved upward from the above-mentioned state, the temporary hanging lever 8 is moved downward so as to slide in the insertion hole portion 7*c*, with the result that the shaft portions 8*b* and 8*c* are moved downward in the bearing groove portions 7*a* and 7*b*. Thus, the temporary hanging lever 8 can be prevented from slipping out of the temporary hanging hook 9 in conjunction with movement of the decorative panel 3. Fine adjustment of the position of the decorative panel 3 can also be easily performed under the state in which the decorative panel 3 is temporarily hung, thereby being capable of performing work of fastening and fixing the decorative panel 3 and the casing 2 to each other with screws.

Even in a case where the decorative panel 3 is moved upward when the decorative panel 3 and the casing 2 are fixed to each other, the temporary hanging lever 8 is moved downward in the insertion hole portion 7*c* so that the shaft portions 8*b* and 8*c* are moved downward in the bearing groove portions 7*a* and 7*b*. Accordingly, the temporary hanging lever 8 is not moved in conjunction with movement of the decorative panel 3, thereby keeping the positional relationship between the temporary hanging lever 8 and the temporary hanging hook 9. Thus, even when the decorative panel 3 and the casing 2 are fastened together, the temporary hanging lever 8 can be kept hooked on the temporary hanging hook 9. Further, even in a case where the decorative panel 3 is moved downward when the screws configured to fasten the decorative panel 3 and the casing 2 together are removed, the temporary hanging lever 8 is kept temporarily hung without changing the positional relationship between the temporary hanging lever 8 and the temporary hanging hook 9. Accordingly, when the decorative panel 3 is dismounted, the temporary hanging hook 9 can be prevented from erroneously slipping off to cause a fall of the decorative panel 3.

In the above description, the hook portion 8*a* is formed into a U-shape, thereby stably maintaining the temporarily hung state. However, the shape of the hook portion 8*a* is not limited to a U-shape, and it is only necessary that the space 8*e* configured to hook the temporary hanging lever 8 on the temporary hanging hook 9 be defined. Further, the shape of the operating portion 8*d* is not limited either, and it is preferred that the operating portion 8*d* be shaped so as to be easily recognizable by finger touch, and to enable a worker to easily perform operation of turning the hook portion 8*a* or sliding the temporary hanging lever 8.

According to the above-mentioned indoor unit 20 for an air-conditioning apparatus of this embodiment, the temporary hanging lever 8 of the decorative panel 3 is turned from a lower surface of the insertion hole portion 7*c*, and then the temporary hanging lever 8 is moved by the gravity, to thereby cause the temporary hanging lever 8 to be hooked on the temporary hanging hook 9. Accordingly, the decorative panel can be temporarily hung easily while being supported by hand. When the decorative panel 3 in the temporarily hung state is moved upward, the temporary hanging lever 8 is moved downward in the insertion hole portion 7*c* so that the shaft portions 8*b* and 8*c* are moved downward in the bearing groove portions 7*a* and 7*b*. Thus, the positional relationship between the temporary hanging lever 8 and the temporary hanging hook 9 is kept without changing. Therefore, the decorative panel 3 can be kept temporarily hung even when fine adjustment of a mounting position of the decorative panel 3, dismounting of the decorative panel 3, or other operations are performed. In addition, the temporary hanging lever 8 can be prevented from unintentionally slipping out of the temporary hanging hook 9.

The shaft portions 8*b* and 8*c* of the temporary hanging lever 8 received in a turnable manner enable the temporary hanging lever 8 to be turned to the orientation perpendicular to the decorative panel 3, to thereby cause the temporary hanging lever 8 to fall into the insertion hole portion 7*c*. Accordingly, the temporary hanging lever 8 can be temporarily hung easily.

The operating portion 8*d* formed between the hook portion 8*a* and the shaft portions 8*b* and 8*c* of the temporary hanging lever 8 enables a worker to perform operation of turning or sliding the temporary hanging lever 8 by placing a finger on the operating portion 8*d*. Accordingly, a worker can easily perform the operation.

Under a state in which the temporary hanging levers 8 are hooked on the temporary hanging hooks 9, the installation screw portions 10 at the four corners of the casing 2 are fastened, to thereby fix the decorative panel 3 to the casing 2. Accordingly, the decorative panel 3 can be prevented from being dropped during installation work, and the work can be performed under a state in which the decorative panel 3 is stable.

Embodiment 2

Figure 8:
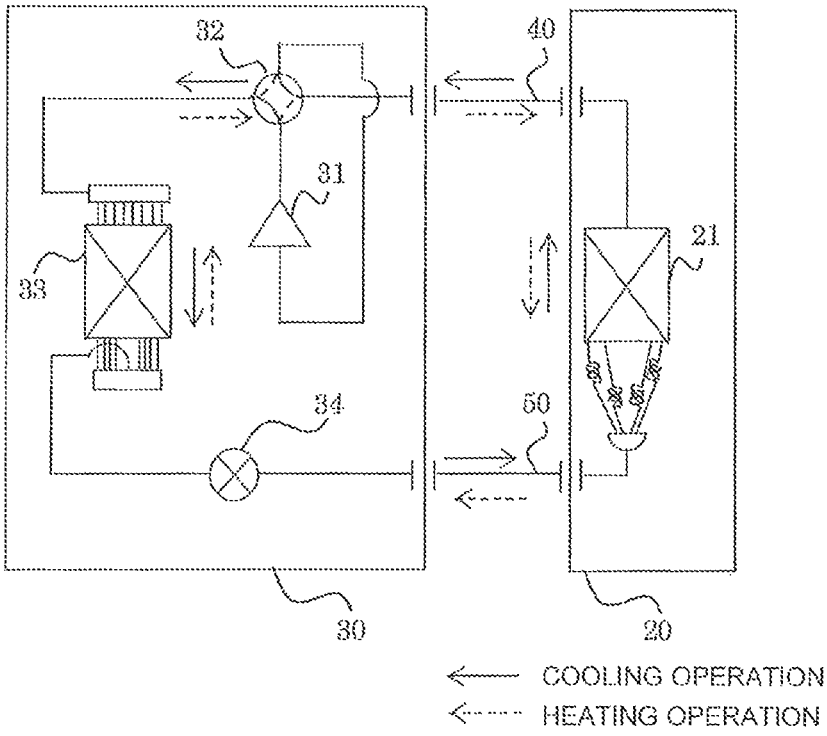
FIG. 8 is a view for illustrating an example of a configuration of an air-conditioning apparatus according to Embodiment 2 of the present invention.

FIG. 8 is a view for illustrating an example of a configuration of an air-conditioning apparatus according to Embodiment 2 of the present invention. The air-conditioning apparatus of FIG. 8 forms a refrigeration cycle through connection of an outdoor unit 30 and the indoor unit 20 described in Embodiment 1 by a gas refrigerant pipe 40 and a liquid refrigerant pipe 50. The outdoor unit 30 includes a compressor 31, a four-way valve 32, an outdoor heat exchanger 33, and an expansion valve 34. As the outdoor unit 30 and the indoor unit 20, components referred to as an outdoor unit and an indoor unit may be used.

The compressor 31 is configured to compress and discharge sucked refrigerant. Although the present invention is not particularly limited, the compressor 31 may change a capacity of the compressor 31 by changing an operating frequency as needed, for example, using an inverter circuit. Herein, the capacity of the compressor 31 refers to an amount of the refrigerant to be fed per unit time. The four-way valve 32, for example, is a valve configured to switch a flow of the refrigerant between the flow during cooling operation and the flow during heating operation.

The outdoor heat exchanger 33 is configured to exchange heat between the refrigerant and outdoor air. For example, during the heating operation, the outdoor heat exchanger 33 functions as an evaporator, and evaporates and gasifies the refrigerant. Further, during the cooling operation, the outdoor heat exchanger 33 functions as a condenser, and condenses and liquefies the refrigerant.

The expansion valve 34 is configured to decompress and expand the refrigerant, and includes an expansion device, a flow rate control unit, and other component. When the expansion valve 34 is constructed by, for example, an electronic expansion valve, an opening degree is adjusted based on an instruction of a control unit (not shown) or other units.

In the indoor unit 20, an indoor heat exchanger 21 is accommodated in the casing 2, and is covered with the decorative panel 3. The decorative panel 3 is fixed under a state in which the temporary hanging levers 8 of the decorative panel 3 are temporarily hung on the temporary hanging hooks 9 of the casing 2. The indoor heat exchanger 21 is configured to exchange heat, for example, between the air in the indoor space 1 and the refrigerant. During the heating operation, the indoor heat exchanger 21 functions as a condenser, and condenses and liquefies the refrigerant. During the cooling operation, the indoor heat exchanger 21 functions as an evaporator, and evaporates and gasifies the refrigerant.

First, the cooling operation of the air-conditioning apparatus is described based on the flow of the refrigerant. During the cooling operation, the four-way valve 32 is switched to establish a connection relationship indicated by the solid lines. High-temperature and high-pressure gas refrigerant compressed and discharged by the compressor 31 passes through the four-way valve 32, and flows into the outdoor heat exchanger 33. Then, liquid refrigerant, which is the refrigerant condensed and liquefied by passing through the outdoor heat exchanger 33 and exchanging heat with the outdoor air, flows into the expansion valve 34. The refrigerant brought into a two-phase gas-liquid state by being decompressed by the expansion valve 34 flows out of the outdoor unit 30.

The two-phase gas-liquid refrigerant flowing out of the outdoor unit 30 flows through the liquid refrigerant pipe 50 into the indoor unit 20, and passes through the indoor heat exchanger 21. Gas refrigerant, which is the refrigerant evaporated and gasified by exchanging heat, for example, with the air in the indoor space 1 flows out of the indoor unit 20.

The gas refrigerant flowing out of the indoor unit 20 flows through the gas refrigerant pipe 40 into the outdoor unit 30. The refrigerant then passes through the four-way valve 32, and is sucked into the compressor 31 again. As described above, the refrigerant of the air-conditioning apparatus is circulated, and cooling is performed by air-conditioning.

Next, the heating operation of the air-conditioning apparatus is described based on the flow of the refrigerant. During the heating operation, the four-way valve 32 is switched to establish a connection relationship indicated by the dotted lines. High-temperature high-pressure gas refrigerant compressed and discharged by the compressor 31 passes through the four-way valve 32, and flows out of the outdoor unit 30. The gas refrigerant flowing out of the outdoor unit 30 flows through the gas refrigerant pipe 40 into the indoor unit 20. The refrigerant condensed and liquefied by exchanging heat, for example, with the air in the indoor space 1 while passing through the indoor heat exchanger 21 flows out of the indoor unit 20.

The refrigerant flowing out of the indoor unit 20 flows through the liquid refrigerant pipe 50 into the outdoor unit 30. The refrigerant brought into a two-phase gas-liquid state by being decompressed by the expansion valve 34 flows into the outdoor heat exchanger 33. Then, liquid refrigerant, which is the refrigerant evaporated and gasified by passing through the outdoor heat exchanger 33 and exchanging heat with the outdoor air, passes through the four-way valve 32, and is sucked into the compressor 31 again. In the above-mentioned manner, the refrigerant of the air-conditioning apparatus is circulated, and heating is performed by air-conditioning.

In the above-mentioned embodiments, the ceiling-concealed indoor unit 20 of a four-way cassette type that blows out the air in four directions is described. However, the present invention is also applicable to the indoor unit 20 that blows out the air, for example, in two directions and three directions.

In the air-conditioning apparatus according to the above-mentioned embodiments, the casing 2 and the decorative panel 3 of the indoor unit 20 are fixed to each other under a state in which the decorative panel 3 is temporarily hung on the casing 2 by the temporary hanging hooks 9 and the temporary hanging levers 8. The temporary hanging levers 8 are turned to move downward by the gravity, thereby being hooked on the temporary hanging hooks 9. Accordingly, the temporary hanging levers 8 do not easily slip out of the temporary hanging hooks 9. Therefore, the decorative panel 3 is temporarily hung in a stable state. As a result, the air-conditioning apparatus enabling easy installation of the decorative panel 3 on the indoor unit can be obtained.

REFERENCE SIGNS LIST

1 indoor space 2 casing 3 decorative panel 4 air inlet grille 5 bellmouth 6 air inlet space 7 air inlet edge portion 7*a*, 7*b* bearing groove portion 7*c* insertion hole portion 8 temporary hanging lever 8*a* hook portion 8*b*, 8*c* shaft portion 8*d* operating portion 8*e* space 9 temporary hanging hook 10 installation screw portion 11 air outlet 20 indoor unit 21 indoor heat exchanger 30 outdoor unit 31 compressor 32 four-way valve 33 outdoor heat exchanger 34 expansion valve 40 gas refrigerant pipe 50 liquid refrigerant pipe

The invention claimed is:

1. An indoor unit for an air-conditioning apparatus, comprising:

a casing having an opening formed on a lower side of the casing when the indoor unit is installed;

a decorative panel mounted on the lower side of the casing and having an air inlet formed into a rectangular shape at a position corresponding to the opening;

levers mounted respectively on two opposed sides among four sides forming edges of the air inlet of the decorative panel; and hooks mounted at the opening of the casing to allow the levers to be hooked thereon, respectively, wherein the decorative panel includes an insertion hole formed in a direction perpendicular to a plane of the decorative panel at a position at which each of the levers is to be mounted, and bearing grooves formed in a lower surface of the decorative panel to extend in parallel with the plane of the decorative panel and extend in directions away from each other with respect to the insertion hole, wherein each of the levers is movable in the insertion hole and includes a hook portion to be hooked on a corresponding one of the hooks and shafts formed at opposite ends of each of the levers, respectively, wherein the hook portion protrudes upward from the insertion hole of the decorative panel, wherein the shafts are configured to be received in the bearing grooves of the decorative panel, respectively, wherein the decorative panel is adapted to, in a temporarily hung state, move downward so that the shafts and the bearing grooves receiving the shafts are engaged with each other, wherein, in the temporarily hung state, the decorative panel is restrained from moving downward from a position at which the shafts are engaged with the grooves, and wherein, when the decorative panel is moved upward from this engaged position, each lever is moved in the respective insertion hole, and the bearing grooves and the shafts are disengaged from each other so that the shafts are moved downward in the bearing grooves.

2. The indoor unit for the air-conditioning apparatus of claim 1, wherein the shafts of each of the levers are received in a pivotal manner in the bearing grooves, respectively.

3. The indoor unit for the air-conditioning apparatus of claim 1, wherein each of the levers further includes an operating portion formed between the shafts and the hook portion, and wherein the hook portion pivots with an operation of the operating portion.

4. The indoor unit for the air-conditioning apparatus of claim 1, wherein the decorative panel and the casing are fixed to each other with screws with the levers being hooked on the hooks, respectively.

5. An air-conditioning apparatus, comprising:

the indoor unit of claim 1; and an outdoor unit, wherein the indoor unit includes an indoor heat exchanger, wherein the outdoor unit includes an outdoor heat exchanger, a compressor, and an expansion device, and wherein the indoor heat exchanger and the outdoor unit are connected by a pipe to form a refrigerant circuit.

6. The indoor unit for the air-conditioning apparatus of claim 1, wherein the insertion hole has an opening formed in a downward-facing surface of the decorative panel.

7. The indoor unit for the air-conditioning apparatus of claim 1, wherein the insertion hole and the bearing grooves are formed in a downward-facing surface of the decorative panel.

8. The indoor unit for the air-conditioning apparatus of claim 1, wherein the bearing grooves are deeper than a diameter of the shafts, so that each shaft remains within a corresponding one of the bearing grooves while the decorative panel moves with respect to the shafts, when the decorative panel is moved upward from the engaged position.

9. The indoor unit for the air-conditioning apparatus of claim 1, wherein the insertion hole passes completely through an air inlet edge portion of the decorative panel so that, upon installing the lever in the decorative panel, the hook portion is passed through the air inlet edge portion from a lower side of the air inlet edge portion to an upper side of the air inlet edge portion.

* * * * *